US007422126B2

(12) United States Patent
Ceschi

(10) Patent No.: US 7,422,126 B2
(45) Date of Patent: Sep. 9, 2008

(54) RECEPTACLE WITH DISPENSER

(76) Inventor: Russell J. Ceschi, 808 Indian Hills Rd., Fontana, WI (US) 53125

( * ) Notice: Subject to any disclaimer, the term of this patent is extended or adjusted under 35 U.S.C. 154(b) by 442 days.

(21) Appl. No.: 10/965,611

(22) Filed: Oct. 14, 2004

(65) Prior Publication Data

US 2005/0082294 A1 Apr. 21, 2005

Related U.S. Application Data

(60) Provisional application No. 60/512,207, filed on Oct. 17, 2003.

(51) Int. Cl.
*B65F 1/06* (2006.01)

(52) U.S. Cl. ..... 220/495.07; 220/908.1

(58) Field of Classification Search ..... None
See application file for complete search history.

(56) References Cited

U.S. PATENT DOCUMENTS 3,392,825 A 7/1968 Gale et al.
3,800,503 A 4/1974 Maki
4,271,878 A * 6/1981 Bologa ..... 141/375
4,319,694 A * 3/1982 Nehrbass et al. ..... 220/495.07
4,666,064 A 5/1987 Hoehn
4,850,507 A 7/1989 Lemongelli et al.
4,869,391 A 9/1989 Farrington
4,955,505 A 9/1990 Battaglia
5,000,340 A * 3/1991 Leggio ..... 220/495.07
5,039,004 A * 8/1991 Simpson ..... 229/132
5,115,935 A 5/1992 Lemongelli
5,183,157 A * 2/1993 Darden ..... 206/390
5,323,902 A * 6/1994 Palmer et al. ..... 206/366
5,632,401 A * 5/1997 Hurd ..... 220/495.07
5,671,847 A 9/1997 Pedersen et al.
5,947,295 A * 9/1999 Lutin ..... 206/554
6,126,031 A * 10/2000 Reason ..... 220/495.07
6,193,095 B1 2/2001 McNeil

* cited by examiner

*Primary Examiner*—Stephen J. Castellano

(57) ABSTRACT

A receptacle or container including a container portion and a base unit for storing bags, liners, sheet material or the like, wherein there is a path between the container portion and the base unit whereby bags, liners, sheet material or the like in the base unit can be moved from the base unit into the container portion, and wherein there are a number of deflectable members associated with the path. In one embodiment, the present invention may be used to handle trash, garbage or recyclables.

5 Claims, 7 Drawing Sheets

RECEPTACLE WITH DISPENSER

CROSS-REFERENCE TO RELATED APPLICATION(S)

The present application claims the priority of U.S. provisional patent application Ser. No. 60/512,207, filed Oct. 17, 2003, the entirety of which is incorporated herein by reference.

BACKGROUND

The present invention relates to containers and receptacles and methods of their use, particularly canisters, storage containers, holders, dispensers and receptacles of various sorts, including cans, containers and receptacles for receiving and containing material, including trash, recyclables, garbage or the like. It further relates to bags, liners, sheet material or the like and their use in containers and receptacles.

SUMMARY

In one embodiment, the present invention comprises a receptacle or container including a container portion and a base unit for storing bags, liners, sheet material or the like, wherein there is a path between the container portion and the base unit whereby bags, liners, sheet material or the like in the base unit can be moved from the base unit into the container portion, and wherein there are a number of deflectable members associated with the path. In one embodiment, the present invention may be used to handle trash, garbage or recyclables.

In one embodiment, the present invention relates to a trash can with a bag dispenser. The bag dispenser can be integral with the can or removably attached or connected to it. That is, the dispenser may be integrally formed or incorporated with a trash receptacle, or it may be a separate unit received in or detachably attached to a trash receptacle.

In one embodiment, the present invention comprises a trash container comprising a container portion and a base unit for storing bags, liners, plastic sheet material or the like, wherein there is a path between the container portion and the base unit whereby bags, liners, plastic sheet material or the like can be moved from the base unit into the container portion for use, and wherein there are a number of generally resilient, flexible guiding, controlling and supporting members associated with the path. In one embodiment, the members are generally between the base unit and container portion. The functions of the members include guiding, controlling and supporting the bags or the like as they move and when they are located, partially and/or completely, in the container portion.

In one embodiment, the present invention comprises a trash container comprising a container portion and a base unit for storing bags, wherein there is an opening between the container portion and the base unit whereby bags can be moved from the base unit through the opening into the container portion for use, and wherein there are a number of generally resilient guiding and controlling members associated with the opening.

In one embodiment, the present invention comprises a trash container comprising a container portion having an open end and a second end which is generally closed but which also defines an opening, a base unit having a portion defining an opening for general alignment with the opening in the second end of the container portion, and a number of generally flexible guiding members associated with the opening in the second end of the container portion and/or the opening in the base unit when said openings are generally aligned. At least one guiding member extending radially inwardly from and abutting the radially inward facing surfaces of both the opening defined at the second end of the container portion and the opening in the base unit. In some embodiments, the members are coupled to at least one of the container portion and the base unit.

In one embodiment, the receptacle of the present invention comprises a generally cylindrical container formed of a single continuous wall and having one end for receiving trash. In some embodiments, the container may be other than generally cylindrical, and/or may taper, being larger at the top than the bottom. The wall defines a generally central cavity for receiving and holding contents. At the end opposite the one end, the receptacle of the present invention includes a base unit or storage area comprising a generally hollow, suitably shaped central containing or storage area. Between the receptacle and base, there is an opening or communication of a suitable size. As shown in FIG. 2, the opening allows one after another of an endless roll of bags to be moved therethrough into the trash container. The bags may comprise the well-known roll of plastic or film trash bags, wherein the bags are separate by a line of weakness or tearable perforations, or they may comprise liners, sheet material or the like. The bags may be made of any suitable material.

In one embodiment, the opening between the trash receiving portion of the receptacle and the bag containing base is provided with a plurality of plastic fingers which are generally flexible and which help control, feed and guide bags through the opening from the bag containing base unit into the trash receptacle. Any number of the plastic fingers can be provided. In one embodiment, they comprise generally triangular sections wherein the base of the triangles is attached to the peripheral edges of the openings and the apex or one point of the triangles is generally centrally located adjacent the points of the other triangles in the center of the opening. In an unflexed or rest position, the fingers generally tend to be generally horizontal and/or generally co-planar with the top wall of the base, generally separating the trash receiving portion and the storage area, thereby tending to generally close the opening and/or help support a trash bag deployed in the container. In some embodiments, the free ends or apexes of the fingers may be rounded, generally flat or have another suitable shape or configuration. In some embodiments, the free ends or apexes of the fingers may be in contact with each other or they may be immediately adjacent to or spaced from each other. The fingers can be formed integrally with one or both of the base unit or receptacle, or they can be connected thereto using a suitable method.

In one embodiment, the bag supply containing base unit at the bottom of the receptacle is provided with a hinged door or flap so that replacement or refill rolls or stacks of bags can be placed in the base. In some embodiments, the opening may be suitably located on a side wall of the base unit.

In some embodiments, the bag storage base unit can be of suitable dimensions, but it is suggested that it be sized to accommodate at least typical rolls of plastic bags, for example, 50-150 four gallon size bags on a roll might be accommodated by one embodiment.

In one embodiment, the container or receptacle of the present invention comprises a container portion and a base unit for storing bags or liners for the container portion, wherein there is a connection or connective path or pathway between the container portion and the base unit whereby bags or lines can be moved from the base unit through the connection into the container portion for use, wherein there are a number of generally resilient guiding and controlling members associated with the connection, and wherein the container and base unit are integral. In other embodiments, the container portion and base unit are removeably associated or attached to each other. In one embodiment, a separate base unit is designed to be received in the container portion, and it and the container include a suitable feature or features for removably connecting or anchoring the base unit to the container, e.g., hook and loop type fabric pieces, snap connectors, certain adhesives, or other suitable complimentary connectors.

In one embodiment, the trash receptacle is sized for smaller applications such as bathrooms, but it can be made available in any size.

In one embodiment, in use, the hinged door in the bag storage base unit is opened and a supply of typical plastic bags, e.g., a roll of trash bags or trash can liners, can be placed therein, and the door is closed. In some embodiments, it may be convenient to start the first bag through the communicating opening into the trash can through the hinged door, although this can be done later as well, for example by reaching down through the receptacle.

In some embodiments, the bottom of the contents containing portion of the receptacle may be provided with an annular snap-type collar around the opening comprising part of the pathway between the base and container for enlarging the opening to accommodate a user's hand or fingers to reach inside the base unit to initiate dispensing of the roll. In some embodiments, the first bag on the roll is reached and grasped from inside the trash receptacle or trash containing portion and pulled upwardly as far as desired, or until the edges of the bag overhang the top edge or edges of the trash receptacle. The trash receptacle, now lined with the bag, can then be used normally. When the bag is full, a user would simply grasp the upper portion of the bag and pull upwardly until the perforations between the full bag and the next bag reach approximately the top of the trash container. At this point, the full bag can be separated from the next, empty bag, and the empty bag opened and deployed within the trash can. The full bag can be disposed of normally.

In some embodiments, the plastic fingers in the opening between the bag storage unit and the trash container help guide and feed bags through the opening, aligning them prior to being unfolded within the trash container, preventing them from failing back into the storage unit, supporting them after they are deployed, etc.

Although continuous rolls of garbage bags are depicted, it should be appreciated that in some embodiments a stacked supply of garbage bags, either continuously connected or separate, may be used as well.

Any suitable characteristic or dimension of trash container and bag storage area or base unit may be used; in general, any characteristic or dimension of any of the features of the receptacle of the present invention may be adapted as suitable. For example, in some embodiments, it might be useful to have a base unit having a circumference larger than that of the upper portion or top edge of the trash containing portion, thereby enhancing stability. The base unit may be formed of heavier material than the trash containing portion or it might be weighted. They can be made from the same material, different weights or thicknesses of the same material, or from different materials.

In some embodiments, the receptacle may be provided with attached cover as is well known.

In one embodiment, the present invention comprises a trash container having a trash receiving portion and an associated base, wherein there is communication between the base and the trash receiving portion whereby a plurality of bags housed in the base may be drawn sequentially into the trash container for typical use.

In some embodiments, the supply of bags in the base can be replenished and, in other embodiments, the trash receptacle, the base unit and bags are all designed to be disposable so that when a supply of bags is exhausted the entire unit can be thrown away.

In some embodiments, the present invention comprises a base unit which is adapted to be used with any customary trash container or receptacle. In this embodiment, the base unit may be available containing a supply of bags, liners or the like, wherein it is to be disposed of when emptied. It may also be designed to be refillable.

While one contemplated and intended use of the container or receptacle of the present invention is as a trash or garbage container, other uses are within the scope of the invention. For example, the container or receptacle could be used to facilitate bagging material for storage, recycling, etc.

The present invention can be made of any suitable material and in any size. In some embodiments, any portion of the invention may be strengthened or reinforced by, for example, providing thickened walls, thickened parts of walls, stiffeners, reinforcing ribs or the like. In some embodiments, the guiding members or fingers can have a shape other than triangular, and their degree of flexibility can be varied.

While multiple embodiments of the present invention, including preferred embodiments, are disclosed and described herein, still other embodiments will become apparent to those skilled in the art. The invention is capable of modifications in various aspects without departing from the spirit and scope of the present invention. Accordingly, the drawings and descriptions herein are to be regarded as illustrative in nature and not restrictive.

DETAILED DESCRIPTION

Figure 1:
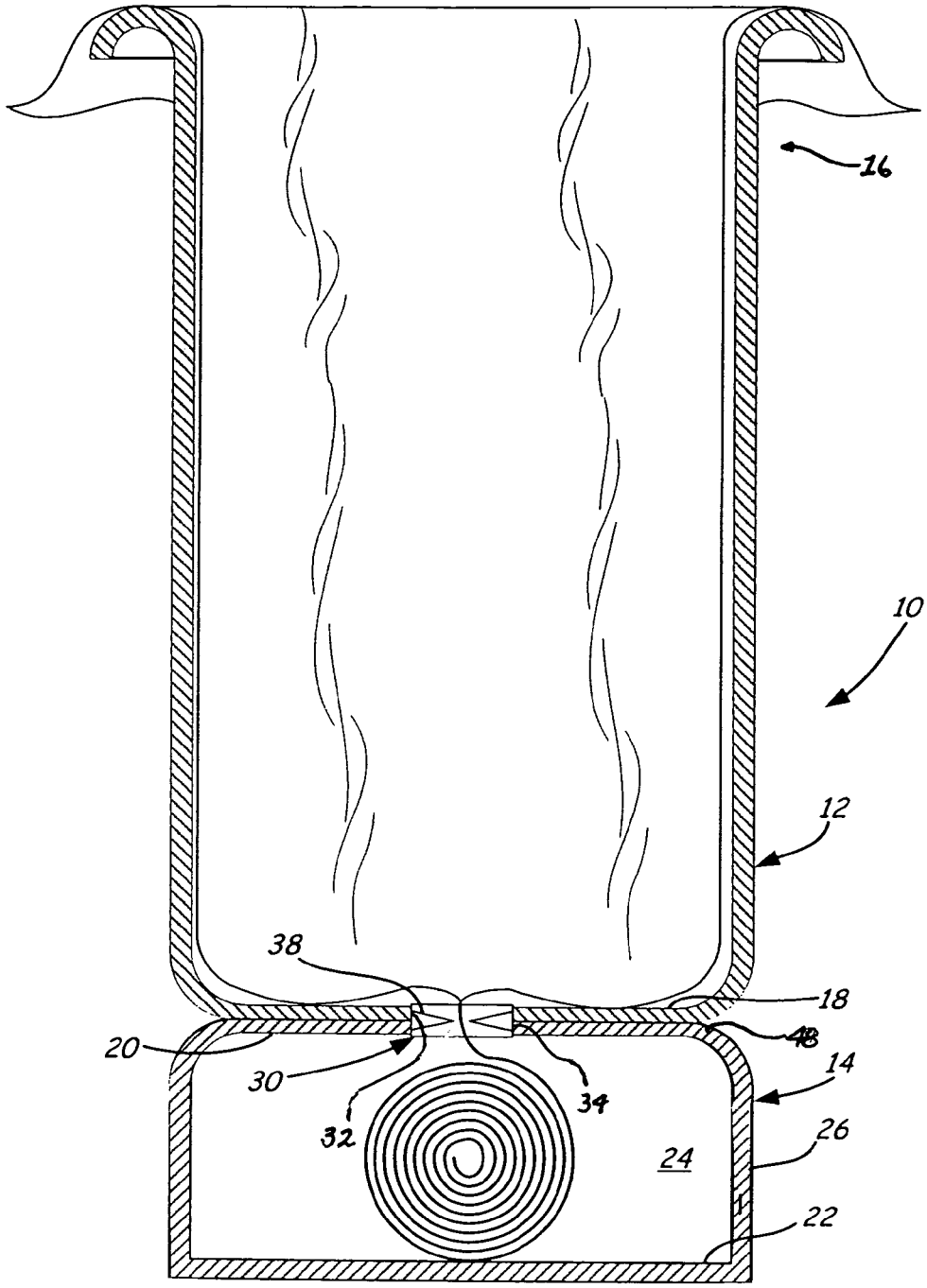
FIG. 1 is an elevational view depicting one embodiment of the present invention.
Figure 2:
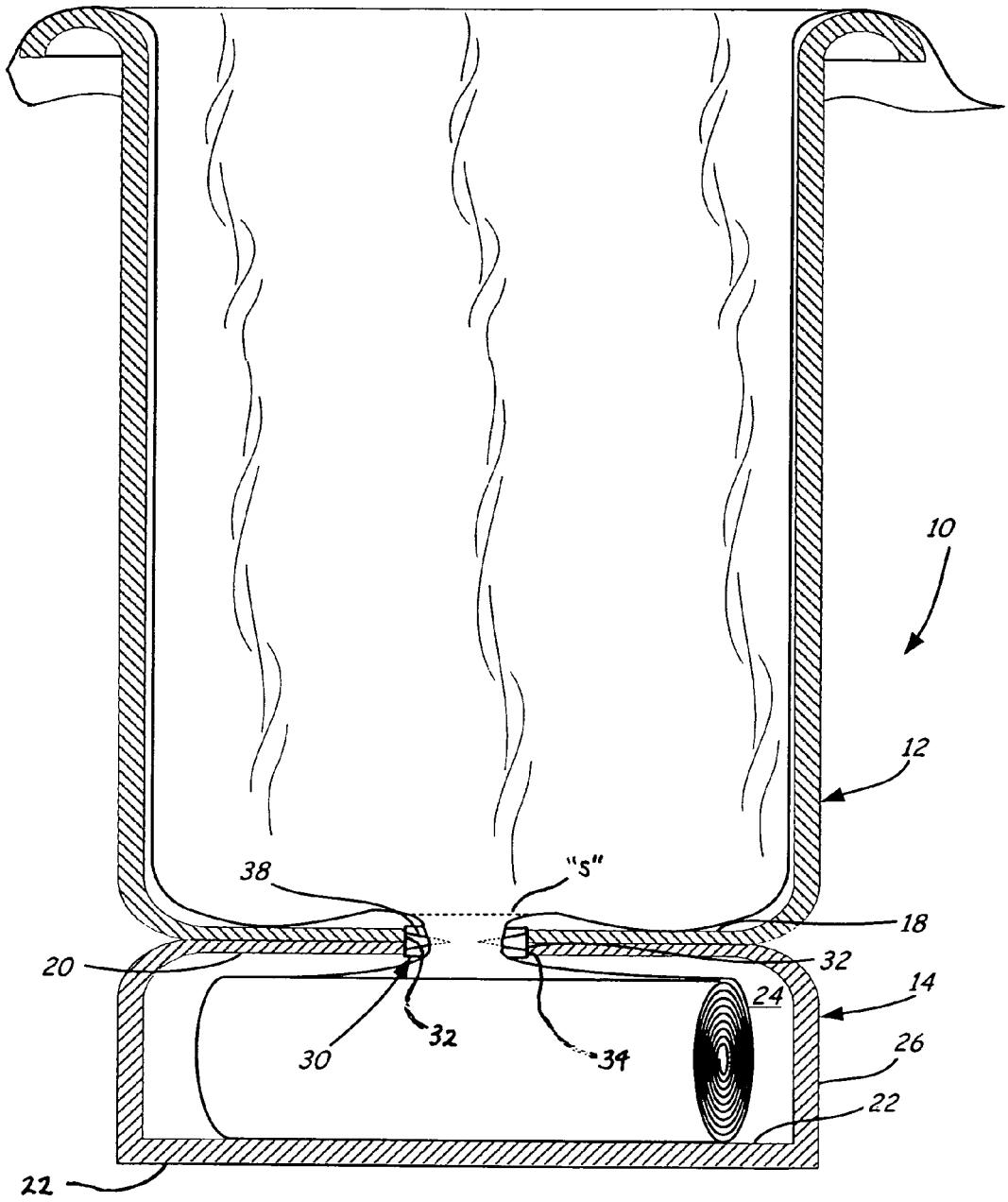
FIG. 2 is an elevational view depicting the embodiment of FIG. 1 from another side thereof.

Referring to FIGS. 1 and 2, one embodiment of the present invention comprises a trash receptacle 10 comprising a trash receiving upper portion 12 and a base unit 14. The trash receiving and containing portion 12 and the base unit 14 can be separably or inseparably joined.

At its upper end 16, the trash containing portion is open. At the opposite, bottom, walled end 18, the trash containing portion is substantially closed and generally congruent with an upper portion 20 of the base 14. In one embodiment, the upper portion comprises a generally continuous wall.

The base unit 14 includes the upper portion 20 and a bottom wall 22. It also has a generally central cavity 24 defined by the sidewalls 26, which can be any suitable shape, comprising either one continuous curved wall or a number of flat angularly related wall facets.

With continued reference to FIGS. 1 and 2, at the bottom wall 18 of the trash container and the top wall 20 of the base unit 14, there is an opening 30, which may also be referred to as an aperture or communication. The opening 30 is formed by aligning an opening 32 in the bottom of the container portion 12 with an opening 34 in the top portion 20 of the base unit 14. The opening 30 may be of any suitable shape such as round, oval, and the like, or it may comprise an elongated, slot-like opening.

Figure 3:
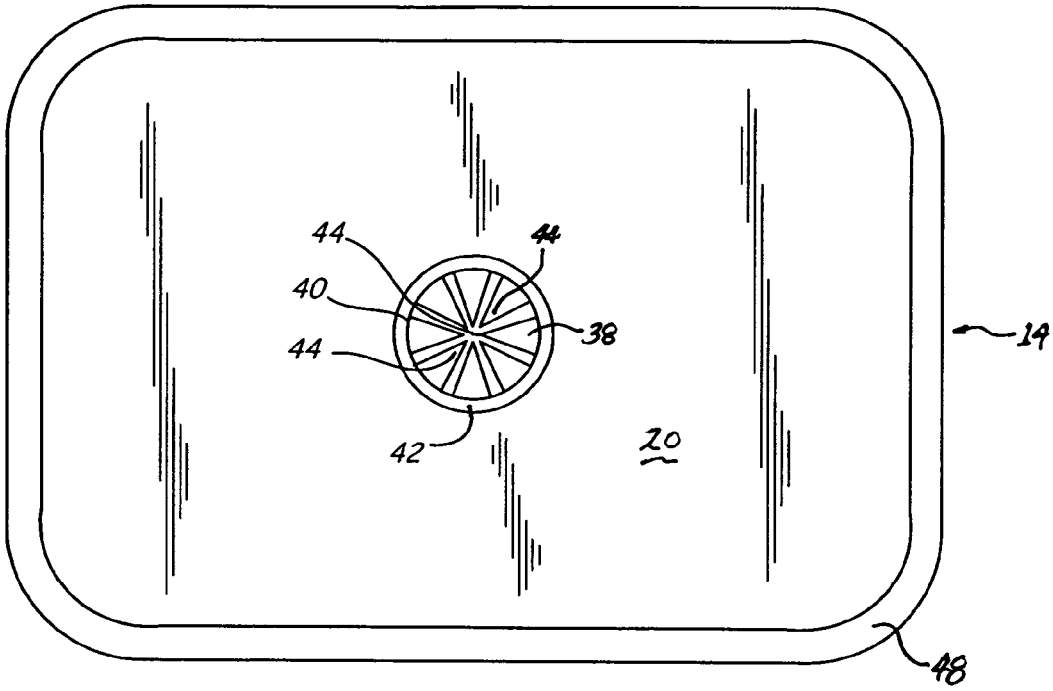
FIG. 3 is a plan view of the top of one embodiment of a base unit in accordance with the present invention.
Figure 3A:
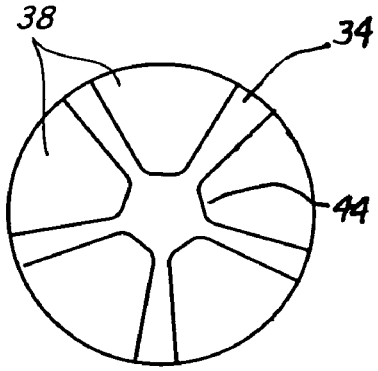
FIGS. 3*a-c* depict some embodiments of the finger members of the present invention.
Figure 3B:
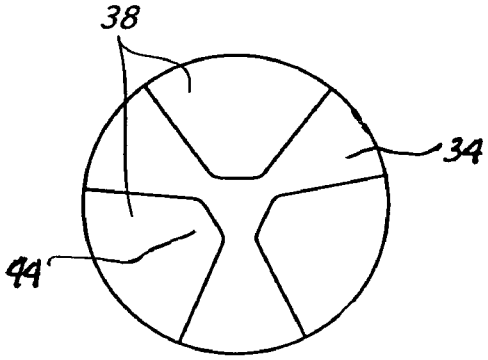
Figure 3C:
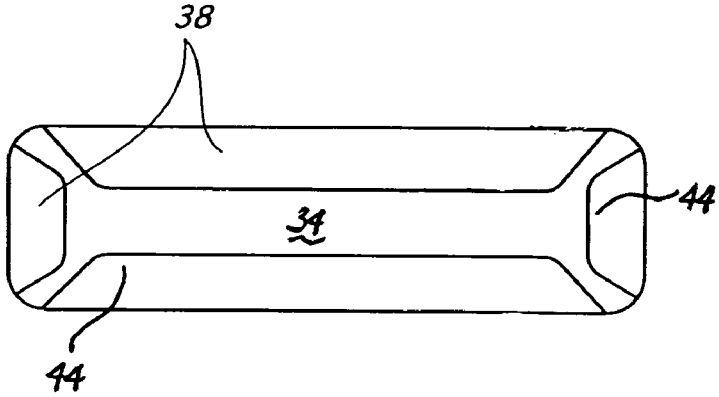

A plurality of flexible finger members 38 are associated with the opening 30. Referring to FIGS. 1 and 3, in one embodiment, the fingers 38 comprise generally triangular bodies having one edge 40 associated with the periphery 42 of the opening 30. Each member includes a free portion 44 generally adjacent to the free portions 44 of the other members 38, and generally adjacent to each other in the center of the opening 30. The fingers 38 are generally flexible and resilient in that they are deflectable from, but generally tend to return to the position depicted in FIG. 1, i.e., a position in which they generally tend to or do substantially occlude or close the opening. Any number of flexible finger members 38 may be provided and the free end 44 may be rounded or shaped appropriately, as shown in FIGS. 3*a-c*. While FIG. 3 depicts the free end 44 generally meeting in the central area of the opening, the ends 44 may be spaced from each other a selected distance whereby a general central smaller opening is left within the opening 30. Similarly, the proximity of the free ends 44 may be adapted to form an opening within the opening of a desired shape. As depicted in FIG. 3, the remainder of the upper wall or top wall of the base unit is substantially uninterrupted.

The trash containing portion 12 and base unit 14 may be adapted to be coupled together by providing suitable attachment means, for example, means adjacent to the periphery 48 of the top wall of the base unit and a complimentary feature along the bottom wall of the trash container 12, or they may be formed as a single, integrated piece.

Figure 4:
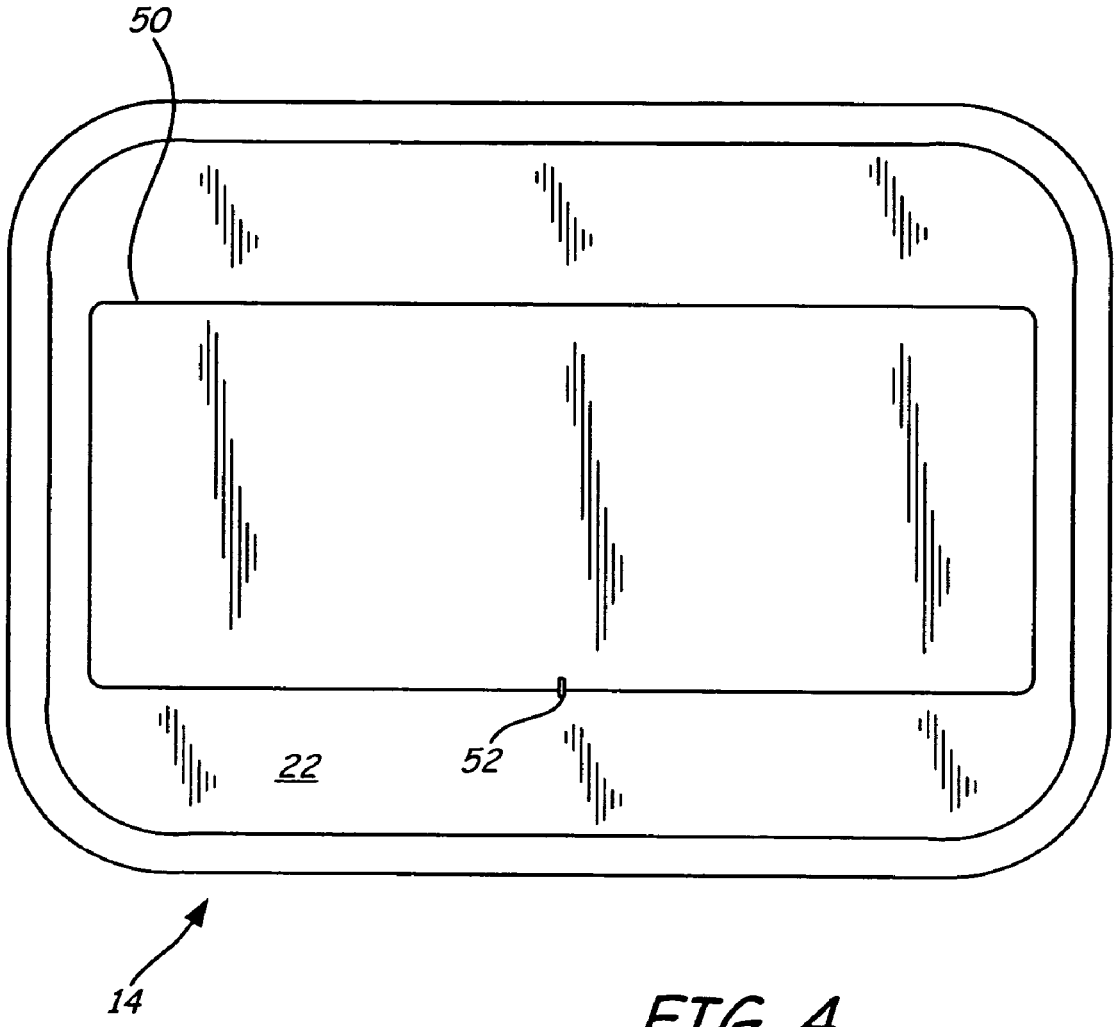
FIG. 4 is a plan view of the bottom of one embodiment of a base unit in accordance with the present invention.

FIG. 4 depicts the bottom wall 22 of the base unit 14. The bottom includes a door 50 provided to enable the refilling of the base unit 14 as will be described in more detail herein below. The door 50 is moveable, for example hinged by a "living hinge," to provide access to the interior of the base unit 14. The base unit 14, and the door 50 may be provided with a suitable closure structure 52. Examples include friction fitting, an integral snap lock or other suitable snap, catch or detent type arrangement.

Figure 5:
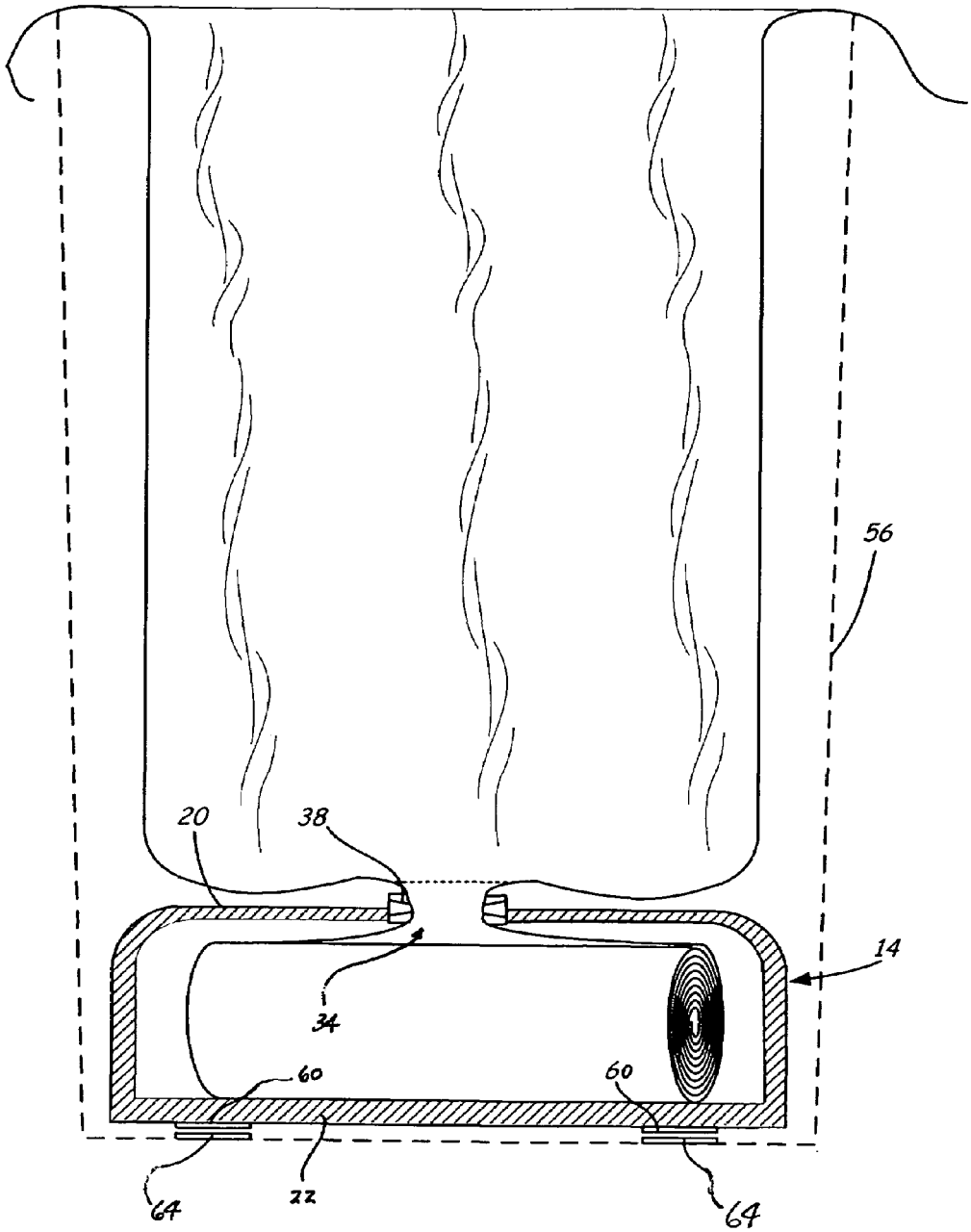
FIG. 5 is an elevational view depicting another embodiment of the present invention.
Figure 6:
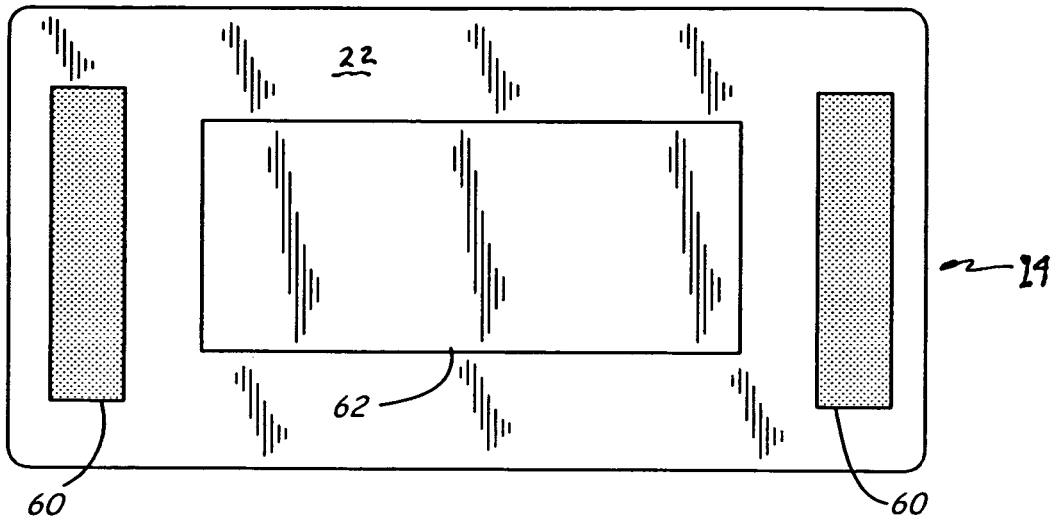
FIG. 6 depicts the bottom of one embodiment of the embodiment shown in FIG. 5.

FIG. 5 depicts another embodiment of the present invention. A typical trash receptacle is shown in phantom at 56. In this embodiment of the invention, the base unit 14 is adapted to be placed inside the trash container 56. The base unit 14 of the embodiment shown in FIG. 5 is generally similar to that depicted in FIG. 1, comprising a suitable top wall 20 and a bottom wall 22. The base unit 14 depicted in FIG. 5 also has an opening 34 generally similar to that of the embodiment depicted in FIG. 1, along with a generally similar arrangement of flexible fingers 38. The base unit 14 depicted in FIG. 5 also includes suitable fasteners or attachment members 60 on the exterior of the bottom wall 22. The fasteners 60 are also depicted in FIG. 6, as is a moveable or removable door or access cover 62 for refilling the base unit 14. The attachment members 60 are designed to be coupled to complimentary attachment members 64 located in a complimentary manner on the inside bottom wall of the trash container 56. One suitable complimentary attachment means comprises "Velcro" or hook and loop fabric type pads which are suitably located on the bottom wall of the base unit 14 and the inside bottom wall of the trash container 56. Adhesives, such as easy or quick release adhesive, may be used, or the attachment means could comprise a snap or friction fit arrangement.

Figure 7:
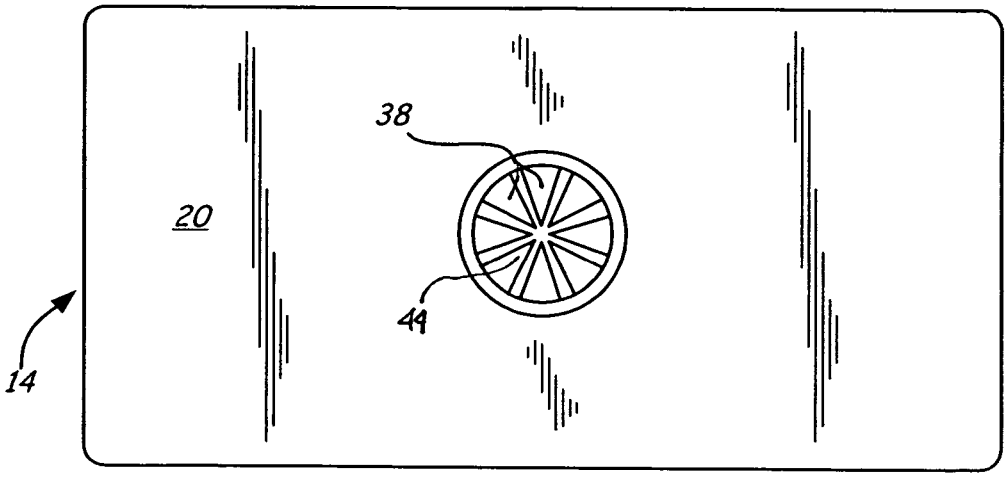
FIG. 7 depicts the top of one embodiment of the embodiment shown in FIG. 5.

The top wall 20 of the base unit 14 of the embodiment of FIG. 5 is depicted in FIG. 7, and it is substantially the same as the embodiment of FIG. 1. In the embodiment depicted in FIGS. 5-7, the base unit 14 can be made in any size suitable for use with any typical trash can.

In use, with reference to FIGS. 1, 2 and 5, a roll of suitable garbage bags or liners, such as typical plastic garbage bags, is placed into the base unit 14. The first bag is drawn upwardly through and past the resilient fingers 38 until its open end overlies the top open end of the container as depicted in FIG. 1. With reference to FIG. 2, at this point, the seam or perforation "S" between the bags would be generally adjacent to the resilient fingers 38 on the garbage container side thereof. The fingers 38 and the bottom wall 18 of the container and the top wall 20 of the base unit 14 help support the bag as it is filled with trash and used. When it is full, the user simply holds the upper edge of the filled bag and lifts, causing the next bag to unroll from the roll in the base unit, moving upwardly through the flexible fingers 38. When the seam or perforation of the filled bag and the next, empty bag is generally aligned with the upper portion 16 of the container 12, the two bags can be separated and the upper edge of the empty bag placed over the top peripheral edge of the container 12. The filled bag can then be disposed of normally.

The flexible fingers 38 provide support and guidance for the plastic bag while they are being fed or travel through the opening 30. They also prevent the next in the series of bags from being pulled or falling back into the base unit as the bags are being manipulated.

For those base units 14 which are refillable, referring to FIGS. 4 and 6, once one roll of bags is exhausted, the access cover 62 or door 50 can be opened and a new roll installed. The first in the sequence or series of bags of the roll may be poked or pushed through the opening 30 from below. The receptacle 10 of the present invention may be then moved to an upright position and the free end of the bag is grasped and pulled upwardly within the container 12 for deployment as described herein above.

In the foregoing description, embodiments of the present invention, including preferred embodiments, have been presented for the purpose of illustration and description. They are not intended to be exhaustive or to limit the invention to the precise forms and steps disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A trash container comprising:

a container portion having an open top end and a bottom end having a bottom through opening;

a base unit having a portion defining a base through opening for alignment with the bottom opening; and a number of generally flexible guiding members associated with the bottom and base openings when said openings are aligned, each of said guiding members comprising a generally trapezoidal body having an apex edge, wherein the guiding members have a rest position in which the guiding members are co-planar with the peripheral edge of the bottom opening and with the peripheral edge of the base opening, at least one guiding member extending radially inwardly from and abutting the radially inward facing surfaces of both the bottom opening and the base opening, the guiding members tending to substantially close said bottom and base openings and support a trash bag in the container portion, said guiding members deflectable from the rest position and tending to return to the rest position after being deflected, wherein the apex edges define a central opening aligned with the aligned bottom and base openings, said deflection expanding the central opening.

2. The trash container according to claim 1, wherein the base unit defines a bag-receiving cavity, and further comprises an access portion for accessing the cavity.

3. The trash container according to claim 2, wherein the container portion and the base unit are integral.

4. The trash container according to claim 2, wherein the container portion and the base unit are releasably connected.

5. The trash container according to claim 1, wherein the bottom, base and central openings are generally congruent when aligned.

* * * * *